US006573656B2

(12) United States Patent
Kaneko et al.

(10) Patent No.: US 6,573,656 B2
(45) Date of Patent: Jun. 3, 2003

(54) HIGH-PRESSURE DISCHARGE LAMP AND METHOD FOR PRODUCING THE SAME

(75) Inventors: Yuriko Kaneko, Nara (JP); Kiyoshi Takahashi, Hirakata (JP); Hideaki Kiryu, Takatsuki (JP); Masato Yoshida, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/903,852

(22) Filed: Jul. 12, 2001

(65) Prior Publication Data

US 2002/0047611 A1 Apr. 25, 2002

(30) Foreign Application Priority Data

Jul. 14, 2000 (JP) ..... 2000-214070

(51) Int. Cl.[7] ..... H01J 61/36
(52) U.S. Cl. ..... 313/623; 313/229
(58) Field of Search ..... 315/246, 248, 315/291; 313/623, 197–200, 228, 229, 332

(56) References Cited

U.S. PATENT DOCUMENTS

| | | | |
|---|---|---|---|
| 3,115,957 A | 12/1963 | Heil | 189/36.5 |
| 3,281,174 A | 10/1966 | Heil | 287/189.365 |

(List continued on next page.)

FOREIGN PATENT DOCUMENTS

| | | |
|---|---|---|
| DE | 198 12 298 A1 | 10/1998 |
| EP | 0 409 439 A1 | 1/1991 |
| EP | 0 574 158 A1 | 12/1993 |
| EP | 0 597 679 B1 | 5/1994 |
| EP | 0 597 679 A1 | 5/1994 |
| EP | 0 883 160 A1 | 12/1998 |
| EP | 0 903 771 A2 | 3/1999 |
| JP | 06-048765 | 2/1994 |
| JP | 06-208831 | 7/1994 |
| JP | 6-208831 | 7/1994 |
| JP | 07-085846 | 3/1995 |
| JP | 10092316 A | 4/1998 |
| JP | 10-269941 | 10/1998 |
| JP | 11162409 A | 6/1999 |
| JP | 11-191391 | 7/1999 |
| JP | 2000-72478 | 3/2000 |
| JP | 2000-315456 | 11/2000 |
| JP | 2002-0008587 | 1/2002 |

OTHER PUBLICATIONS

Jess Stein, The Random House College Dictionary, p. 1081, 1224.*

Japanese Patent Application 11–162409 corresponds to European Patent Publication No. EP 0 903 771 A2.

Japanese Patent Application 6–208831 corresponds to European Patent Publication No. EP 0 597 679 A1.

Japanese Patent Application 11–162409 corresponds to European Patent Publication No. EP 0 903 771 A2.

Japanese Patent Application 6–208831 corresponds to European Patent Publication No. EP 0 883 160 A1.

*Primary Examiner*—Don Wong
*Assistant Examiner*—Wilson Lee
(74) *Attorney, Agent, or Firm*—Harness, Dickey & Pierce, P.L.C.

(57) ABSTRACT

A high-pressure discharge lamp includes an arc tube portion enclosing a luminous material in the tube; a side tube portion substantially made of quartz glass that extends from the arc tube portion; and an electrode rod whose first end is arranged in the arc tube portion and a part of which is provided in the side tube portion. The electrode rod is substantially made of tungsten. A region containing at least one of copper oxide and copper is present in at least a part of the portion of the side tube portion in which the part of the electrode rod is positioned.

12 Claims, 5 Drawing Sheets

U.S. PATENT DOCUMENTS 3,558,951 A * 1/1971 Kramei ..... 313/25
3,566,178 A * 2/1971 Mori ..... 313/229
3,714,494 A * 1/1973 Nakamura ..... 313/198
3,852,630 A * 12/1974 Wesselink et al. ..... 313/228
3,959,682 A 5/1976 Wesselink et al. ..... 313/217
4,282,395 A 8/1981 Hagemann ..... 174/50.61
5,128,588 A * 7/1992 Kameya et al. ..... 313/623
6,069,456 A 5/2000 Fromm et al. ..... 315/248
6,137,228 A 10/2000 Aizawa et al. ..... 313/631

* cited by examiner

HIGH-PRESSURE DISCHARGE LAMP AND METHOD FOR PRODUCING THE SAME

BACKGROUND OF THE INVENTION

The present invention relates to a high-pressure discharge lamp in which the internal pressure is 1 atmospheric pressure or more during operation and a method for producing the same.

FIG. 14 shows an example of the configuration of a conventional high-pressure discharge lamp. The high-pressure discharge lamp shown in FIG. 14 includes an arc tube (bulb) portion 50 and side tube portions 51 extending from the arc tube portion 50. The heads of electrode rods 52 are positioned inside the arc tube portion 50, and a part of the electrode rods 52, metal foils 53 whose first ends are electrically connected to the electrode rods 52, and a part of external lead wires 54 electrically connected to the other (second) ends of the metal foils 53 are provided in the side tube portions 51.

Mercury and metal halide, which are luminous species 56, are enclosed in the arc tube portion 50. The electrode rods 52 are substantially made of tungsten, and the side tube portions 51 are substantially made of quartz glass. The coefficient of thermal expansion of tungsten of the electrode rods 52 is different from that of quartz glass of the side tube portions 51, so that it is difficult for these two materials to be hermetically attached. Therefore, the tungsten is hermetically attached to the quartz glass by plastically deforming the thin metal foils 53, thus maintaining the airtightness in the arc tube portion 50.

Although it appears that the electrode rods 52 and the side tube portions 51 are hermetically attached, in reality, very small gaps 55 are present. It is known that the luminous species 56 enters the gap 55 while the lamp is repeatedly turned on and off. The temperature of these significantly small gaps 55 is lower than that of the arc tube portion 50 during lamp operation, so that the luminous species 56 hardly evaporates again to return to the arc tube portion 50. As a result, the luminous species 56 present in the arc tube portion 50 is decreased so that proper emission cannot be obtained. Furthermore, when the luminous species 56 reaches the metal foils 53 through the gaps 55, the metal foils 53 may be detached from the side tube portions 51, which may cause leaks in the arc tube portion 50 and thus the life of the lamp may be shortened.

Conventionally, there have been attempts to solve this problem. For example, Japanese Laid-Open Patent Publication No. 10-269941 discloses a technique of attaching tungsten coils to the electrode rods. In this technique, the coils are formed in a pitch that does not allow melted quartz glass to go into the coil pitch at the time of sealing. This publication describes that by performing sealing while stretching the coils to the discharge end side of the electrode rods, no gap that might accommodate the luminous materials such as metal halide and mercury is formed in portions of the electrode rods near the metal foils. More sepcifically, when sealing is performed while stretching the coils to the discharge end side, the coils are extended. Therefore, the inner diameter of the coils near the metal foils becomes small so that the coils are in contact with the outer surface of the electrode rods. In addition, the coil pitch is increased, so that melted quartz glass enters between the coils. As a result, the quartz glass becomes in contact with the outer surface of the electrode rods, so that the gap to which otherwise the luminous material might enter is filled.

However, although the gap to which the luminous materials might enter can be filled, the method of this publication has the following problem. Since this method fails to take the difference in the coefficient of the thermal expansion between tungsten and quartz glass, the lamp is broken after repetitive operation of on and off of the lamp because of failure of absorption of the difference in the coefficient of thermal expansion. In the above method, since the coils are wound tightly around the electrode rods, the coils cannot be plastically deformed, unlike the thin metal foils. In this state, when the lamp is operated, the electrode rods expand because of Joule heat, and this force presses quartz glass to the point where the lamp is broken. That is to say, the method of this publication is not practical in the lamp that is required to turn on and off repeatedly.

SUMMARY OF THE INVENTION

Therefore, with the foregoing in mind, it is a main object of the present invention to provide a high-pressure discharge lamp having a long life and a method for producing the same.

A high-pressure discharge lamp of the present invention includes an arc tube portion enclosing a luminous material in the tube; a side tube portion substantially made of quartz glass that extends from the arc tube portion; and an electrode rod whose first end is arranged in the arc tube portion and a part of which is provided in the side tube portion, wherein the electrode rod is substantially made of tungsten, and a region containing at least one of copper oxide and copper is present in at least a part of the portion of the side tube portion in which the part of the electrode rod is positioned.

It is preferable that the side tube portion in the region is made of the at least one of copper oxide and copper, Vycor glass, and quartz glass.

It is preferable that the at least one of copper oxide and copper is contained in an amount of 1% by weight to 30% by weight in the side tube portion in the region.

It is preferable that the high-pressure discharge lamp further includes a metal foil electrically connected to a second end of the electrode rod and provided in the side tube portion, wherein the metal foil is electrically connected to an external lead wire.

In one embodiment of the present invention, the side tube portion in the region and the electrode rod are attached tightly to each other, and at least a part of the side tube portion other than the region and the metal foil are attached tightly to each other.

It is preferable that the region is present on the metal foil side from the center between an end of the arc tube portion that is a border with the side tube portion and an end of the metal foil that is connected to the electrode rod.

It is preferable that the diameter of the electrode rod is 0.3 mm or less.

In one embodiment of the present invention, at least metal halide is enclosed in the arc tube portion as the luminous material.

In one embodiment of the present invention, the metal halide includes a halide of indium.

According to another aspect of the present invention, a method for producing a high-pressure discharge lamp includes the steps of: (a) preparing a glass tube including an arc tube portion, a side tube portion extending from the arc tube portion, and substantially made of quartz glass; (b) passing an electrode rod substantially made of tungsten through a cylindrical structure containing at least one of copper oxide and copper; (c) inserting the electrode rod into the side tube portion such that a first end of the electrode rod is positioned in the arc tube portion; and (d) forming a region containing the at least one of copper oxide and copper in the side tube portion by heating the cylindrical structure and the side tube portion for tight attachment.

In one embodiment of the present invention, the cylindrical structure in the step (b) is a glass cylinder made of the at least one of copper oxide and copper, Vycor glass and quartz glass.

In one embodiment of the present invention, the cylindrical structure in the step (b) is obtained by adhering glass powder containing at least one of copper oxide powder and copper powder to a glass sleeve made of Vycor glass.

It is preferable that in the step (b), the electrode rod, which is connected to a metal foil at a second end of the rod, is passed through the cylindrical structure such that at least a part of the metal foil is covered with the cylindrical structure.

It is preferable that in the step (c), the electrode rod is inserted into the side tube portion such that the cylindrical structure is arranged on the metal foil side from the center between an end of the arc tube portion that is a border with the side tube portion and an end of the metal foil that is connected to the electrode rod.

In the present invention, a region including at least one of copper oxide or copper is present in at least a part of the portion of a side tube portion in which a part of the electrode rod is positioned. Therefore, the side tube portion positioned in that region and the electrode rod are tightly attached satisfactorily. This prevents the enclosed luminous species from entering into a small gap between the electrode rod and the side tube portion. As a result, leaks in the arc tube portion caused by the detachment of the metal foil from the side tube portion can be prevented. Furthermore, since leaks in the arc tube portion are prevented by tight attachment between the side tube portion positioned in that region and the electrode rod, a high-pressure discharge lamp can be provided, that is not broken even if the lamp is turned on and off repeatedly and thus has a long life.

According to the present invention, since a region containing at least one of copper oxide and copper is present in at least a part of the portion of a side tube portion in which a part of an electrode rod is positioned, the lamp life of a high-pressure discharge lamp can be improved.

This and other advantages of the present invention will become apparent to those skilled in the art upon reading and understanding the following detailed description with reference to the accompanying figures.

DETAILED DESCRIPTION OF THE INVENTION

Figure 1:
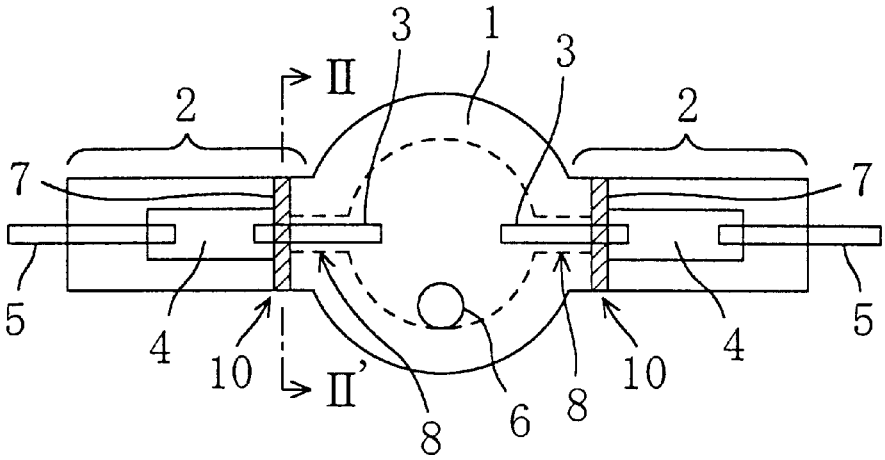
FIG. 1 is a schematic cross-sectional view showing the configuration of a high-pressure discharge lamp of an embodiment of the present invention.

The inventors of the present invention made research to meet conflicting requirements of tight attachment of the side tube portions and the electrode rods of a high-pressure discharge lamp and prevention of the lamp breakage during lamp operation. In this research, they found by means of experiments that when a region including copper oxide is provided in a part of the side tube portion and the side tube portion in that region and the electrode rod are attached, surprisingly, the side tube portion and the electrode rod can be attached tightly, and the lamp is prevented from being broken, and thus attained the present invention.

Hereinafter, embodiments of the present invention will be described with reference to the accompanying drawings. In the drawings, for simplification, elements having substantially the same function bear the same reference numeral. The present invention is not limited to the following embodiments.

Figure 2:
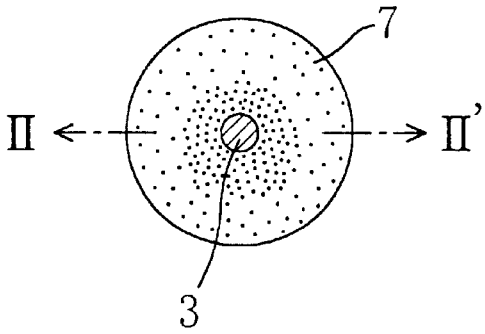
FIG. 2 is a cross-sectional view taken along line II–II' of FIG. 1.

FIG. 1 is a schematic cross-sectional view of a high-pressure discharge lamp of this embodiment. FIG. 2 is a schematic cross-sectional view taken along line II–II' of FIG. 1.

The high-pressure discharge lamp shown in FIG. 1 is a metal halide lamp containing a metal halide as a luminous material 6, and includes an arc tube (bulb) portion 1 enclosing the luminous material 6 inside and side tube portions 2 extending from the arc tube portion 1. The arc tube portion 1 and the side tube portions 2 are substantially made of quartz glass, that is, include quartz glass as the main material. A pair of electrode rods 3 is arranged in the arc tube portion 1 such that the heads thereof are opposed to each other, and the electrode rods 3 are substantially made of tungsten, that is, include tungsten as the main material.

A part of the electrode rods 3 is positioned in the inside of the tube portions 2, and a region 7 including at least one of copper oxide and copper is present in at least a part of the portion of the side tube portion 2 in which the electrode rods 3 are positioned. In this embodiment, the electrode rods 3 are tungsten rods having a diameter (rod diameter) of 0.25 mm. First ends (ends on the electrode rod base side) of the electrode rods 3 are electrically connected to metal foils 4 positioned inside the side tube portions 2, and the metal foils 4 are electrically connected to external lead wires 5 on the side opposite to the side connected to the electrode rods 3. The metal foils 4 and the electrode rods 3 are connected by welding, and so are the metal foils 4 and the external lead wires 5. The metal foils 4 are substantially made of molybdenum, that is, include molybdenum as the main material. The metal foils 4 and the side tube portions 2 are attached tightly by plastic deformation of the metal foils 4, and thus the airtightness is maintained in the inside of the arc tube portion 1. In other words, the side tube portions 2 serve as sealing portions (seal portions).

Figure 14:
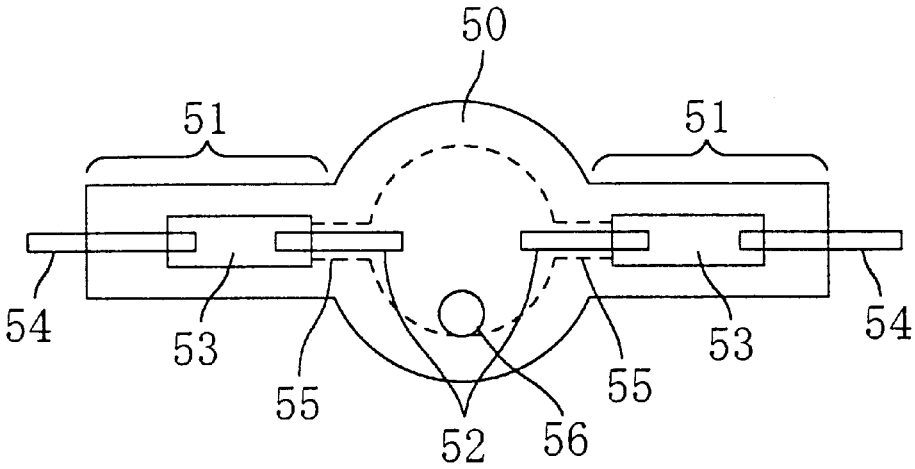
FIG. 14 is a schematic cross-sectional view showing the configuration of a conventional high-pressure discharge lamp.

The arc tube portion 1 in this embodiment is a transparent vessel having a substantially spherical shape that is made of quartz glass. A discharge space constitutes the inside of the vessel. The outer diameter of the central portion of the arc tube portion 1 is 6.0 mm, the thickness thereof is 1.6 mm, and the inner volume is 0.025 cc. The arc tube portion encloses 0.1 mg of $InI_3$, 0.1 mg of TlI, 0.16 mg of $ScI_3$, 0.16 mg of NaI as the luminous materials (luminous species) 6, and xenon gas as the start-up aid gas at 1.4 MPa (at 25° C.). On the other hand, the arc tube portion 1 of this embodiment does not enclose Hg (mercury), unlike the configuration shown in FIG. 14. In other words, the lamp of this embodiment is a so-called mercury-free metal halide lamp. However, the present invention is not limited to mercury-free halide lamps, but can apply to mercury metal halide lamps containing mercury (mercury high-pressure discharge lamps).

As shown in FIG. 1, small gaps 8 are present between the electrode rods 3 and the side tube portions 2 because of the difference in the coefficient of thermal expansion therebetween. These gaps 8 occur spontaneously in the sealing process of the electrodes. In FIG. 1, for visual understanding, the gaps 8 are larger than actual ones, and actual gaps are too narrow to be visually observed. These gaps 8 are blocked at regions 7 of the side tube portions 2. That is to say, the side tube portions 2 positioned in the regions 7 including at least one of oxide copper and copper and the electrode rods 3 are attached tightly to each other.

The side tube portions 2 positioned in the regions 7 are quartz glass layers in which, for example, copper oxide and Vycor glass (manufactured by Corning Corp.) are mixed. The Vycor glass (product name) is glass with improved processability than quartz glass, which is improved by mixing an additive with the quartz glass to lower the softening point. The composition thereof is, for example, 96.5% by weight of silica ($SiO_2$), 0.5% by weight of alumina ($Al_2O_3$), and 3% by weight of boron (B).

The inventors of the present invention confirmed by means of experiments that the side tube portions can be attached tightly to the electrode rods 3 when the regions 7 are formed of a quartz glass layer not containing Vycor glass and containing oxide copper. In this embodiment, copper oxide is used as the additive. When the composition of the quartz glass layer containing copper oxide was analyzed, it was confirmed that the copper was present mostly in the form of copper rather than in the form of copper oxide in the quartz glass layer. The reason why the copper is present in the form of copper in the quartz glass layer (region 7) is not clear, but it is speculated that oxygen in the copper oxide is taken by quartz glass (silica) for some reason, so that the copper is present in the form of copper.

The regions 7 (quartz glass layers) are provided in a part of the side tube portions 2 in the longitudinal direction, and when these regions are viewed from the outside, spots of black, red or brown particles are dispersed in the glass. In this embodiment, the regions 7 are present in positions 10 near the ends of the metal foils 4 that are connected to the electrode rods 3. In other words, the regions 7 are present on the side of the metal foils 4 from the center between the ends (the border between the arc tube portion 1 and the side tube portions 2) of the arc tube portion 1 and the ends of the metal foils 4 that are connected to the electrode rods 3. In the configuration shown in FIG. 1, the faces of the quartz glass layer (7) on the side of the metal foils 4 (on the side of the external lead wires 5) are positioned substantially in the same position as the end faces of the metal foils 4 on the side of the arc tube portion 1. Therefore, the quartz glass layers (7) are attached to the electrode rods 3 on the side of the metal foils 4 (i.e., the positions 10) from the center. In this embodiment, the length of the electrode rods 3 positioned in the side tube portions 2 is about 5 mm, and the portions having a length of about 1 mm of the electrode rods near the positions 10 are attached to the quartz glass layer (7).

As shown in FIG. 2, in the regions 7, copper oxide (additive materials; shown by spots in FIG. 2) and Vycor glass (not shown) are distributed from the electrode rods 3 toward the outer walls of the side tube portions 2. In this example, copper oxide and Vycor glass are contained in a larger amount in the vicinity of the electrode rods 3 than in the vicinity of the outer walls of the side tube portions 2. Copper oxide (or copper) is contained in an amount of, for example, about 1 to about 30% by weight in the side tube portions 2 (quartz glass layer) in the regions 7. When the amount exceeds 30% by weight, the content of the metal element components is so large that it becomes difficult to maintain the glass state. Therefore, it is preferable that the content is 30% by weight or less. When the content is about 1% by weight or more, the effects of improving tight attachment can be obtained, and it is more preferable that the content is about 5 to about 25% by weight.

Figure 3:
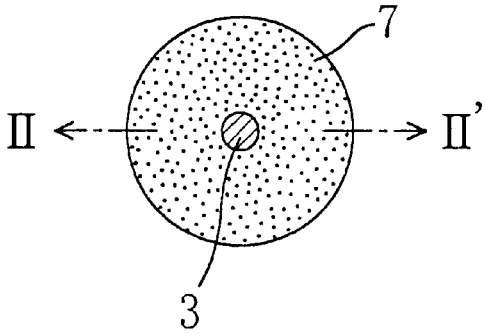
FIG. 3 is a cross-sectional view taken along line II–II' of FIG. 1.

FIG. 2 shows the configuration in which copper oxide (or copper) and Vycor glass are distributed non-uniformly, but as shown in FIG. 3, copper oxide (or copper) and Vycor glass can be distributed uniformly. Furthermore, as described above, it is not necessary to contain Vycor glass in the quartz glass layer (7), as long as at least one of copper oxide and copper is contained therein.

The inventors of the present invention conducted the following test to check whether or not the lamp shown in FIG. 1 can operate without the facts that the luminous material 6 that has slipped into the electrodes reaches the metal foils 4 and that no leaks occur.

In the case where the lamp shown in FIG. 1 is operated at a rated power of 35W, the operating pressure is estimated to be about 14 MPa. In this test, in order to increase the load at the early stage of operation, a power of 70 W, which is about twice the rated power, is applied as a load to the lamp for about 30 seconds at the early stage of operation. Then, an operation of being on for five minutes and being off for five minutes constitutes one cycle, and the cycle is repeated.

This experiment is conducted to ten lamps without the regions 7 in the configuration shown in FIG. 1 (comparative examples) and ten lamps of this embodiment. The results are as follows. In all of the comparative examples, the luminous species 6 entered up to the ends of the metal foils 4 at 10 cycles of the on-and-off cycle. The test continued further, and at 100 cycles of the on-and-off cycle, leaks occurred. On the other hand, in all of the lamps of this embodiment, the luminous species 6 not only did not enter there at 10 cycles of the on-and-off cycle, but also at 100 cycles of the on-and-off cycle, leaks did not occur.

The state of the gaps 8 was observed in the following manner. First, the lamps for experiments were processed such that ink can be injected therein. After injecting ink (New coccine, food red No.102) into the inside of the arc tube portion 1 with an injector, the side tube portions 2 were put in water and ultrasonic vibration was applied thereto in order for the ink to enter the narrow gaps 8. Then, the lamps were left undisturbed for several hours. When the lamps were observed, the following was found. In the lamps of the comparative examples, the ink entered along the electrode rods 3 to the connection portion between the metal foils 4 and the electrode rods 3. On the other hand, in the lamps of this embodiment, such advancement was not observed.

Figure 4:
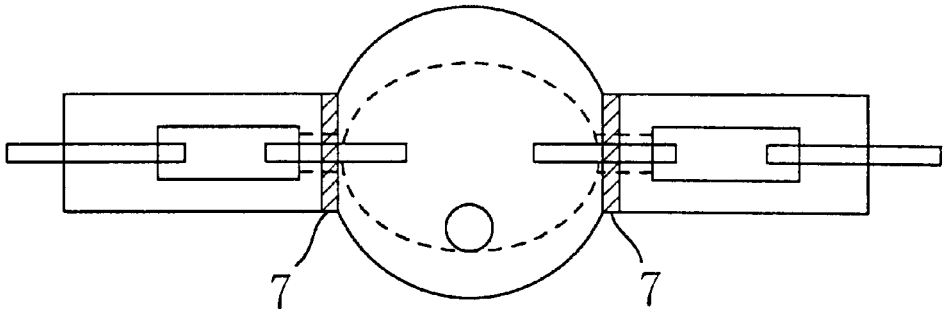
FIG. 4 is a schematic cross-sectional view showing the configuration of a high-pressure discharge lamp of an embodiment of the present invention.

Next, the effects of changing the positions of the regions 7 (quartz glass layer) were confirmed by means of experiments. Lamps in which the regions 7 were provided in the ends of the side tube portions 2 on the side of the arc tube portion 1, as shown in FIG. 4, and lamps in which the regions 7 were provided in the positions 1 mm away from the ends (the border between the arc tube portion 1 and the side tube portions 2) (FIG. 3), as shown in FIG. 4, were prepared, and the same test as described above was conducted. The results were as follows. In the lamps having the regions 7 at the ends, cracks occurred, and metal halide entered up to the metal foils 4, and leaks occurred. However, in the lamps having the regions 7 in the positions 1 mm away, there was no cracks or no leaks occurred.

The possible reason for this seems to be as follows. As the positions of the regions 7 (quartz glass layers) come closer to the arc tube portion 1, the temperature of the regions 7 is increased, and the load due to the on-and-off operation is increased. Therefore, it is preferable that the portions (regions 7) where the electrode rods 3 are tightly attached to the side tube portions 2 are positioned at least 1 mm away from the ends of the side tube portions 2 on the side of the arc tube portion 1. It is also desirable to provide the regions 7 on the side of the metal foils 4 from the center between the ends of the arc tube portion 1 (the border between the arc tube portion 1 and the side tube portions 2) and the ends of the metal foils 4 that are connected to the electrode rods 3. When the regions 7 are provided in positions near the arc tube portion 1, it seems preferable to take some measure to suppress an increase of the temperature of the regions 7 during operation.

Furthermore, the inventors of the present invention prepared two types of lamps: lamps having electrode rods 3 with a diameter of 0.4 mm and lamps of 0.3 mm, and conducted the same test. In the lamps using the electrode rods 3 having a diameter of 0.4 mm, cracks occurred, and as a result, metal halide entered up to the metal foils 4, and leaks occurred. However, in the lamps using the electrode rods 3 having a diameter of 0.3 mm, there were no cracks, or no leaks occurred. This is because as the diameter of the electrode rods 3 is increased, the volume ratio of the electrode rods 3 to the side tube portions 2 is increased, so that it becomes difficult to reduce the difference in the coefficient of thermal expansion. Therefore, it is preferable that the diameter of the electrode rods 3 is 0.3 mm or less. Furthermore, in the lamps using the electrode rods 3 having a diameter exceeding 0.3 mm (for example, 0.4 mm), it is necessary to design the lamp with consideration for the design of the side tube portions 2 (especially, the design of the volume ratio of the electrode rods 3 to the side tube portions 2 or the like). More specifically, in the configuration shown in FIG. 1, it is preferable to increase the size of the lamp (especially the size of the side tube portions 2).

Figure 5:
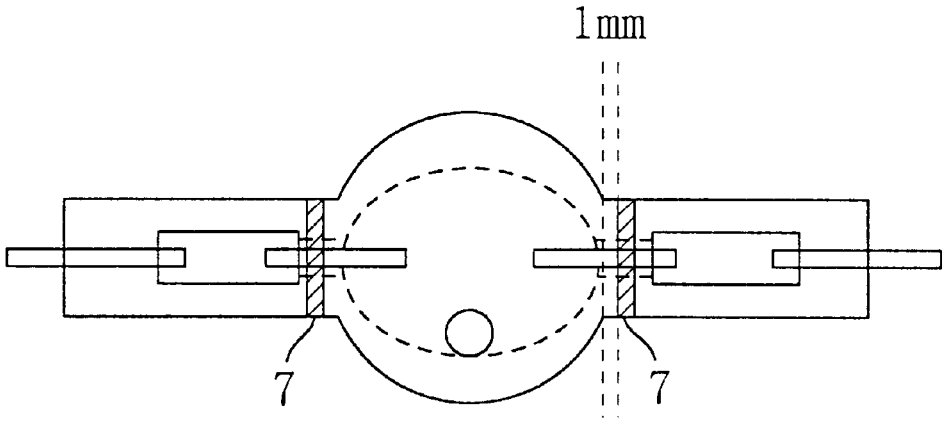
FIG. 5 is a schematic cross-sectional view showing the configuration of a high-pressure discharge lamp of an embodiment of the present invention.
Figure 6:
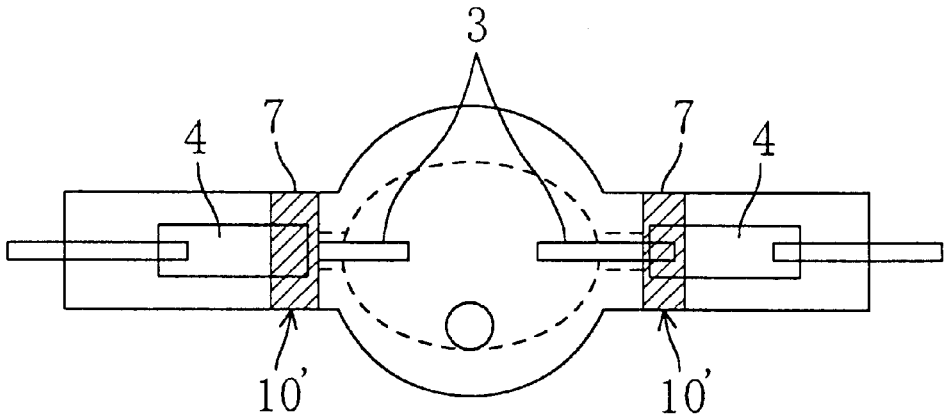
FIG. 6 is a schematic cross-sectional view showing the configuration of a high-pressure discharge lamp of an embodiment of the present invention.

In the examples shown in FIGS. 1, 4 and 5, the regions 7 are provided so as not to reach the metal foils 4 in the side tube portions 2. However, as shown in FIG. 6, the regions 7 can be formed so as to partially overlap the metal foils 4. The inventors of the present invention produced a lamp in which the regions 7 were arranged in the peripheries 10' of the end faces of the metal foils 4 on the side of the arc tube portion 1, and not only the electrode rods 3, but also a part of the metal foils 4 were sealed by the quartz glass layer (7) (see FIG. 6), and conducted the same test as described above with respect to this lamp. The results were that in the lamp shown in FIG. 6, there were no cracks, or no leaks occurred. In view of these results and a useful advantage in that the adhesion between the metal foils 4 and the side tube portions 2 is improved, it is preferable to seal a part of the metal foils 4 by the side tube portions 2 (quartz glass layer) in the regions 7 as well.

The reason why occurrence of cracks and occurrence of leaks in a high-pressure discharge lamp are prevented by providing the regions 7 in predetermined positions in the side tube portions 2 is not clear at present. Hereinafter, the illustrative coefficient of thermal expansion of each portion will be described with reference to the cross-sectional view shown in FIG. 2. The coefficient of thermal expansion of tungsten constituting the electrode rod 3 in the center is about $46\times10^{-7}$/°C., whereas the coefficient of thermal expansion of quartz glass is about $5.5\times10^{-7}$/°C. Although the coefficient of thermal expansion of the side tube portions 2 in the regions 7 (quartz glass layers) is between the coefficient of thermal expansion of tungsten and the coefficient of thermal expansion of quartz glass, it is about $7\times10^{-7}$/°C., which is a level substantially equal to the coefficient of thermal expansion of quartz glass. The coefficient of thermal expansion of quartz glass containing copper oxide (or copper) as an additive is about $7\times10^{-7}$/°C., and the coefficient of thermal expansion of vycor glass is about 7×10–7/°C. In view of these respects overall, it cannot be said that the coefficient of thermal expansion of the side tube portions 2 in the regions 7 (quartz glass layers) is close to that of tungsten. Therefore, it is speculated that the copper oxide or copper in the regions 7 somehow interact with the tungsten of the electrode rods 3, and thus preventing occurrence of cracks and leaks during operation.

The effect of preventing leaks by means of sealing with regions 7 provided in a part of the side tube portions 2 can be exhibited more significantly when the luminous material 6 is metal halide. This is because the vapor pressure of the metal halide is lower than that of mercury or rare gas, so that when the metal halide enters into the gaps 8 present around the electrode rods 3, it becomes very difficult for the metal halide to return to the arc tube portion 1, compared with mercury and rare gas.

Furthermore, it is known that metal halide brings impurities such as moisture into the arc tube portion 1, and therefore, the moisture reduces the strength of the lamp, and the incidence of leaks is increased. A halide of sodium, a halide of scandium, a halide of holminum, a halide of lithium, and a halide of gadolinium are materials that especially can adsorb moisture to a large extent among metal halides, so that a larger advantage is provided when the technique of the present invention is applied to metal halide lamps enclosing the above-described metal halides.

A halide of indium or a halide of thallium that has a high vapor pressure, compared with other metal halides, although they have a lower vapor pressure than that of mercury, slips into the gaps 8 easily. Even after slipping into the gaps 8, the halide tries to evaporate in the gaps 8, so that the quartz glass is pressed by that expansion, that is, the gaps 8 becomes large. As a result, leaks are promoted. Therefore, a large advantage is provided when the technique of the present invention is applied to metal halide lamps enclosing a halide of indium or a halide of thallium. In addition, in the case of mercury-free metal halide lamps, there is a strong tendency that the amount of metal halide to be enclosed is large, compared with metal halide lamps containing mercury, and therefore the technique of the present invention can apply more preferably to mercury-free metal halide lamps. That is to say, this is because in the metal halide lamps that do not enclose mercury, in order to attain a predetermined value for the lamp voltage or the like, it is necessary to enclose metal halide (especially one having a high vapor pressure) as a substitute for mercury in a larger amount.

Next, an example of a method for producing the lamp of this embodiment will be described with reference to FIGS. 7 to 13.

Figure 7:
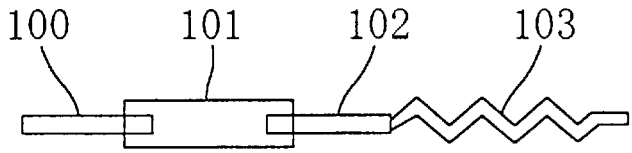
FIG. 7 is a schematic cross-sectional view showing the configuration of an electrode structure (electrode).

FIG. 7 schematically shows the configuration of an electrode structure (also referred to simply as "electrode") that will be inserted into a lamp. The electrode structure shown in FIG. 7 includes an electrode rod 100, a metal foil 101, and an external lead wire 102. A metal spring 103 is provided in the end of the external lead wire 102. In this embodiment, the electrode rod (tungsten rod) 100 is joined to the metal foil (molybdenum foil) 101 by welding, and the external lead wire 102 is joined to the metal foil 101 by welding. The electrode rod 100 is electrically connected to the external lead wire 102 via the metal foil 101. The metal spring 103 is a member for holding the electrode structure in the tube of the side tube portion, and other members than the metal spring 103 can be used, as long as it can hold the electrode structure.

Figure 8:
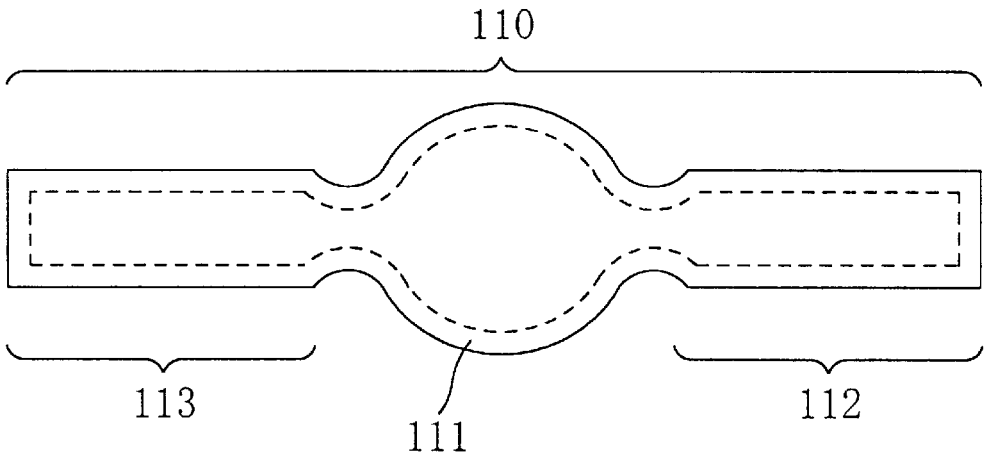
FIG. 8 is a schematic cross-sectional view showing the configuration of a glass tube 110 for a discharge lamp.

FIG. 8 shows a glass tube 110 for a discharge lamp prepared in a separate process. The glass tube 110 includes an arc tube portion 111, and side tube portions 112 and 113 extending from both ends of the arc tube portion 111. The arc tube portion 111 is a hollow and substantially spherical portion that is made into a predetermined shape by heating and expanding a part of a cylindrical quartz glass tube. On the other hand, the side tube portions 112 and 113 are portions of quartz glass other than the portion in which the arc tube portion 111 is formed. The glass tube 110 for a discharge lamp shown in FIG. 8 is produced so that recesses are formed between the arc tube portion 111 and the side tube portions 112 and 113. The diameter of the side tube portions 112 and 113 in this embodiment is 4 mm for the outer diameter and 2 mm for the inner diameter. The side tube portion 112 is opened at both ends, and one end of the side tube portion 113 is closed.

Figure 9:
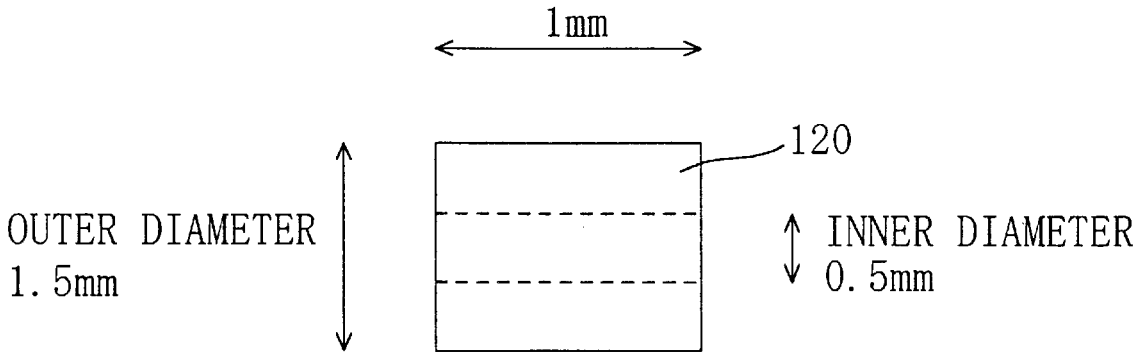
FIG. 9 is a schematic cross-sectional view showing the configuration of a glass sleeve 120.

FIG. 9 shows a glass cylinder 120 constituted by at least one of copper oxide and copper, Vycor glass, and quartz glass. The glass cylinder 120 in this embodiment is a glass sleeve (glass bead tube) in which quartz glass, Vycor glass, and copper oxide are mixed. The content of the oxide copper in the glass sleeve 120 is, for example, about 1 to about 30% weight, preferably about 5 to about 25% by weight. Alternatively, a glass sleeve 120 in which Vycor glass is not mixed can be used. The outer diameter of the glass sleeve 120 shown in FIG. 9 is 1.5 mm and the inner diameter thereof is 0.5 mm. The length is 1 mm.

Figure 10:
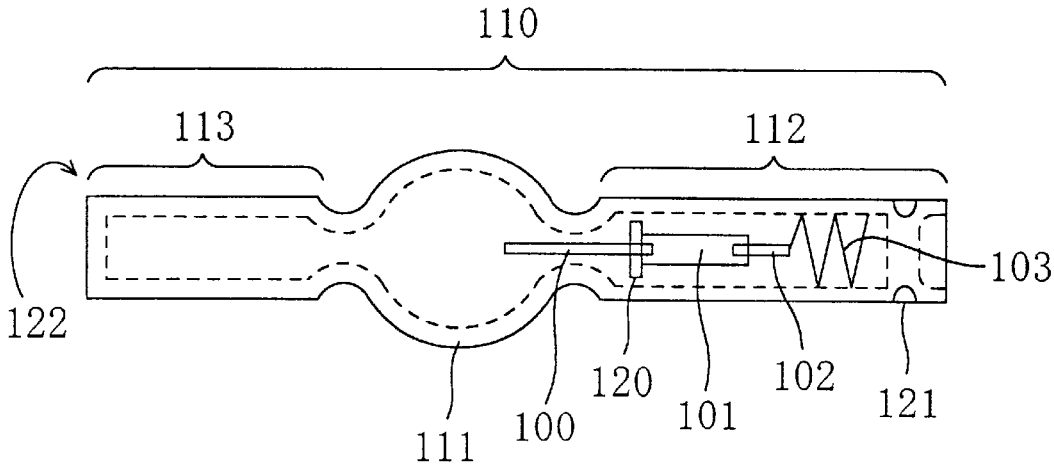
FIG. 10 is a cross-sectional view illustrating a process sequence of the insertion process of the electrode structure and the evacuation process of the glass tube 110.

First, the electrode rod 100 of the electrode structure is passed through the glass sleeve 120, and the electrode structure (100 to 103) is inserted into the side tube portion 112, as shown in FIG. 10.

More specifically, the insertion of the electrode structure (100 to 103) is carried out by pressing the electrode structure with an insertion rod (not shown) having a diameter sufficiently smaller than the inner diameter of the side tube portion 112. In this case, the electrode structure is secured by a contact of the metal spring 103 with the inner wall of the side tube portion 112. The insertion of the electrode structure is performed with observation with a CCD, and the electrode rod 100 and the glass sleeve 120 are arranged in predetermined positions.

Next, in this state, the glass tube 110 is evacuated. Although not shown in FIG. 10, the glass tube 110 is supported by a rotatable chuck, and the glass tube 110 is rotated in a direction, for example, indicated by arrow 122. Thereafter, while the glass tube 110 is evacuated, a portion 121 near the end of the side tube portion 112 that is not sealed yet is heated for sealing. FIG. 10 schematically shows the configuration of the glass tube where the portion 121 near the end of the side tube portion 112 is sealed.

Figure 11:
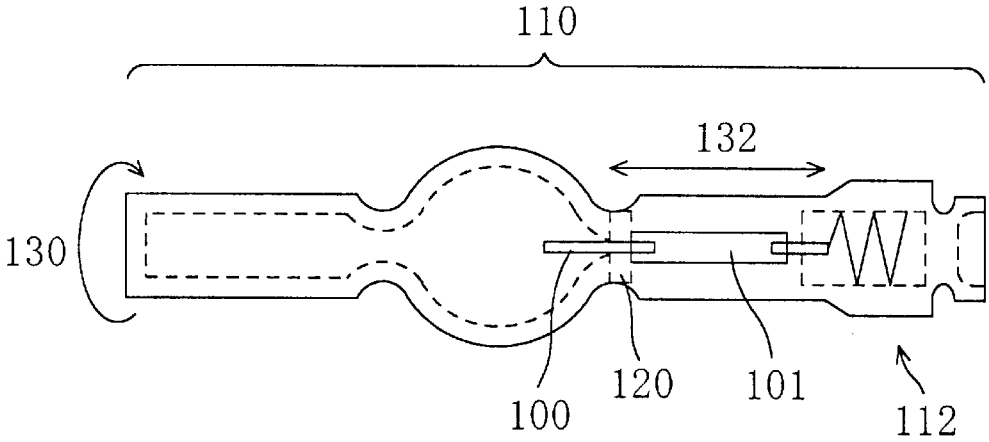
FIG. 11 is a cross-sectional view illustrating a process sequence of the sealing process of the electrode structure.

Then, while the tube 110 is supported by the rotatable chuck, the glass tube 110 is rotated in a direction, for example, indicated by arrow 130, as shown in FIG. 11. Then, a portion 132 of the side tube portion 112 in which the metal foil 101 or the like is positioned is heated and melted, and thus the side tube portion 112 is hermetically sealed. In this case, the glass sleeve 120 is melted as well as the quartz glass material of the side tube portion 112, so that the glass sleeve 120 is attached tightly to the electrode rod 100. Thereafter, heating is stopped for spontaneous cooling. During this spontaneous cooling, in the portion where the quartz glass and the electrode rod 100 are tightly attached, the quartz glass is detached from the electrode rod 100 because of the difference in shrinkage therebetween so that small gaps (8 in FIG. 1) are formed. However, in the portion where the electrode rod 100 and the glass sleeve 120 are attached, no gap (8) is formed. This may be partly because the difference in the coefficient of thermal expansion between tungsten and quartz glass is alleviated by the glass sleeve 120 containing Vycor glass and copper oxide, but no definite reason is known at present.

In the above-described processes, one electrode is sealed in the arc tube. In the configuration shown in FIG. 11, when the portion of the glass sleeve 120 containing Vycor glass and copper oxide is viewed, the appearance is such that spots of black particles are dispersed.

Figure 12:
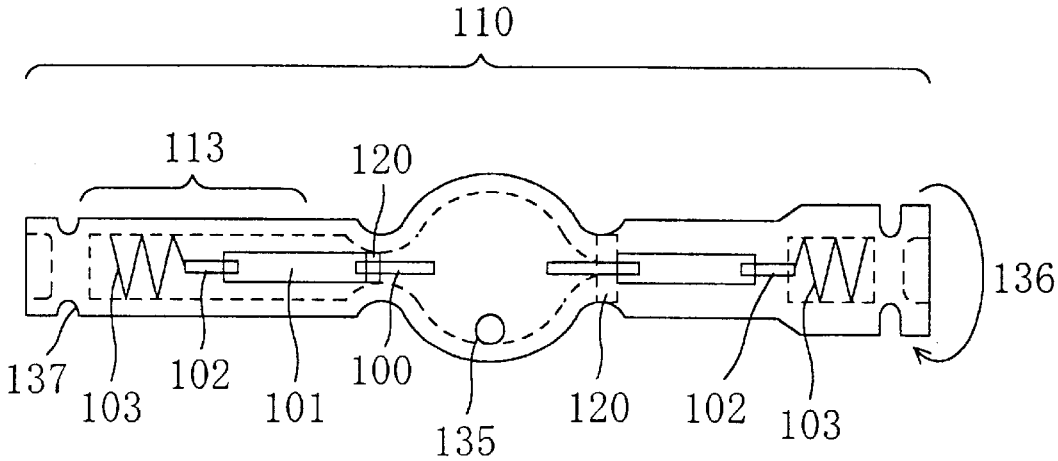
FIG. 12 is a cross-sectional view illustrating a process sequence of the insertion process of the electrode structure and the evacuation process of the glass tube 110.

Next, as shown in FIG. 12, the electrode structure (100 to 103) is inserted into the other side tube portion 113. More specifically, the closed end of the side tube portion 113 in the configuration shown in FIG. 11 is cut, for example with a cutter, and then metal halide or the like (135) that is a luminous material of a lamp is introduced from that opening. Then, in this state, the electrode structure (100 to 103) is inserted as described above. Thereafter, as shown in FIG. 12, the glass tube 110 is evacuated again.

Following this process, the glass tube 110 is supported by a rotatable chuck (not shown), and then the glass tube 110 is rotated in a direction, for example, indicated by arrow 136. Next, the glass tube 110 is evacuated, and then dry xenon gas is introduced in a predetermined amount. Thereafter, a portion 137 near the end of the side tube portion 113 is heated for sealing.

Finally, in the same manner as in the process for hermetically sealing the side tube portion 112 shown in FIG. 11, the electrode structure is sealed in the side tube portion 113. In this stage, however, since the arc tube portion 111 encloses metal halide and xenon gas, it is preferable to perform hermetical sealing while cooling, for example, with water. Thereafter, in order to obtain the same lamp as shown in FIG. 1, the glass is cut at the ends of the two side tube portions (112, 113) with a cutter, so that the external lead wires 102 shown in FIG. 12 are exposed. At this point, the metal springs 103 present at the ends of the two electrode structures can be removed. Thus, the lamp of this embodiment can be obtained.

In the embodiment described above, the glass sleeve 120 in which quartz glass, copper oxide and vycor glass are mixed is used. However, as described above, a glass sleeve constituted by quartz glass and at least one of copper oxide and copper can be used. Alternatively, a glass sleeve constituted by Vycor glass and at least one of copper oxide and copper can be used.

Alternatively, a glass sleeve made of Vycor glass and to which glass powder (quartz glass powder or Vycor glass powder) containing copper oxide powder is physically adsorbed (e.g., adsorption by moisture or adsorption by static electricity) can be used. In the case where the lamp of this embodiment is produced with a glass sleeve made of Vycor glass and to which glass powder containing copper oxide powder adheres, the inventors of the present invention confirmed by means of experiments that when viewing the portions (regions 7) of the side tube portions 2 in which the glass sleeve is inserted, the appearance is such that spots of red particles are dispersed.

Furthermore, a glass sleeve 120 made of Vycor glass that is plated with copper and then is oxidized can be used. Alternatively, the predetermined position of the electrode rod 100 can be plated with copper and oxidized, and thereafter, the glass sleeve 120 made of Vycor glass can be arranged in its circumference. That is to say, the advantages of this embodiment that the luminous species does not reach the metal foil even if the on-and-off operation is repeated and that leaks and the like do not occur can be obtained not only by the technique of providing the presence of copper oxide and Vycor glass around the electrode rod 100, but also by the technique of providing the regions 7 containing at least one of copper oxide and copper is provided in a certain portion of the side tube portions 2, as in the configuration shown in FIG. 1.

Figure 13:
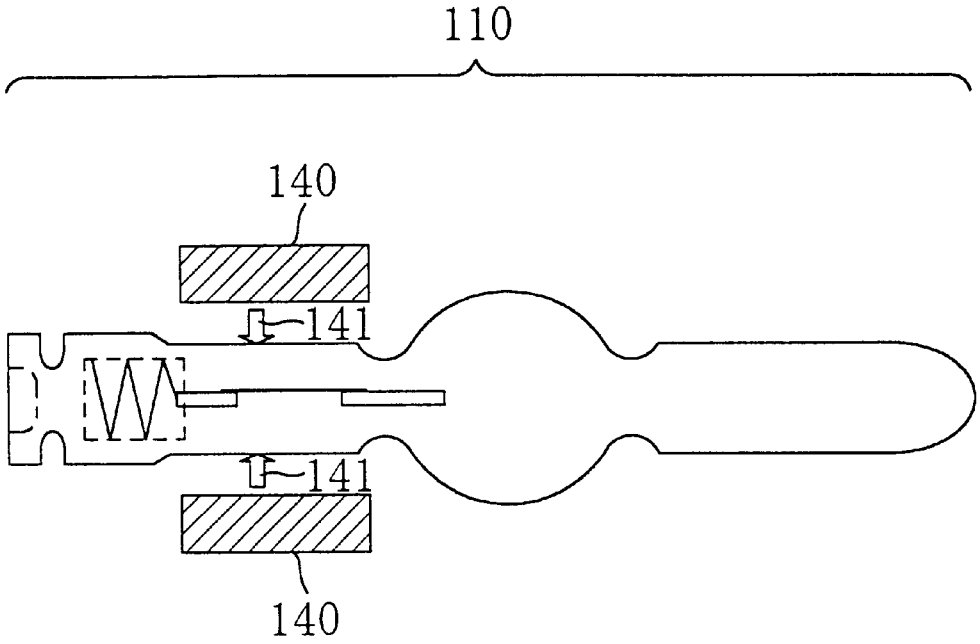
FIG. 13 is a cross-sectional view illustrating a process sequence of the sealing process of the electrode structure with a mold 140.

In the embodiment described above, as the sealing method, the technique of sealing (so-called shrink method) is used including the steps of heating and melting the outer tube of the sealing portions while reducing the pressure in the arc tube portion 1, to bake and shrink the outer tube of the sealing portion, thereby producing the side tube portions (sealing portions) 2 having a shrink structure. However, the present invention is not limited thereto. For example, as shown in FIG. 13, the following technique (so-called pinching method) can be used without any particular problems to obtain the lamp of this embodiment: After the side tube portions (sealing portions) are heated and melted, the rotation of the arc tube portion 111 is stopped. Then, the sealing portions are compressed promptly with a mold 140 in a direction indicated by arrow 141 for molding. According to this technique, since molding with a mold is performed, the lamp advantageously can be molded so as to have sealing portions with a designed shape without non-uniformity with ease.

In addition, in the embodiment described above, a mercury-free metal halide lamp has been described as an example, but the present invention can apply preferably to a metal halide lamp containing mercury. The present invention also can apply to a high-pressure discharge lamp in which airtightness in the arc tube portion 1 is achieved by the side tube portions 2 (e.g., high-pressure mercury lamps or ultra high pressure mercury lamps). Furthermore, in the embodiment described above, a high-pressure discharge lamp using the metal foils (4 or 101) has been described, but the present invention is not limited thereto, and can apply to high-pressure discharge lamps (metal halide lamps, mercury lamps or the like) without the metal foils. In other words, since the arc tube portion 1 can be hermetically sealed by tight attachment between the regions 7 and the electrode rods 3, it is possible to constitute a high-pressure discharge lamp without the metal foils. In the case of the configuration of a high-pressure discharge lamp without the metal foils, the electrode rods (3) made of tungsten extend up to the external lead wires (5) through the side tube portions 2.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A high-pressure discharge lamp comprising:

an arc tube portion enclosing a luminous material in the tube;

a side tube portion substantially made of quartz glass that extends from the arc tube portion; and an electrode rod whose first end is arranged in the arc tube portion and a part of which is provided in the side tube portion, wherein the electrode rod is substantially made of tungsten, and a region containing at least one of copper oxide and copper is present in at least a part of a portion of the side tube portion in which the part of the electrode rode is positioned, wherein the at least one of copper oxide and copper is contained in an amount of 1% weight to 30% by weight in the side tube portion in the region.

2. The high-pressure discharge lamp according to claim 1, wherein the side tube portion in the region is made of the at least one of copper oxide and copper, Vycor glass, and quartz glass.

3. The high-pressure discharge lamp according to claim 1, further comprising a metal foil electrically connected to a second end of the electrode rod and provided in the side tube portion, wherein the metal foil is electrically connected to an external lead wire.

4. The high-pressure discharge lamp according to claim 3, wherein the side tube portion in the region and the electrode rod are attached tightly to each other, and at least a part of the side tube portion other than the region and the metal foil are attached tightly to each other.

5. The high-pressure discharge lamp according to claim 3, wherein the region is present on the metal foil side from a center between an end of the arc tube portion that is a border with the side tube portion and an end of the metal foil that is connected to the electrode rod.

6. The high-pressure discharge lamp according to claim 1, wherein a diameter of the electrode rod is 0.3 mm or less.

7. The high-pressure discharge lamp according to claim 1, wherein at least metal halide is enclosed in the arc tube portion as the luminous material.

8. The high-pressure discharge lamp according to claim 7, wherein the metal halide includes a halide of indium.

9. A method for producing a high-pressure discharge lamp comprising the steps of:

(a) preparing a glass tube including an arc tube portion, a side tube portion extending from the arc tube portion, and substantially made of quartz glass;

(b) passing an electrode rod substantially made of tungsten through a cylindrical structure containing at least one of copper oxide and copper;

(c) inserting the electrode rod into the side tube portion such that a first end of the electrode rod is positioned in the arc tube portion; and (d) forming a region containing the at least one of copper oxide and copper in the side tube portion by heating the cylindrical structure and the side tube portion for tight attachment, wherein the cylindrical structure in the step (b) is a glass cylinder made of the at least one of copper oxide and copper Vycor glass and quartz glass.

10. The method for producing a high-pressure discharge lamp according to claim 9, wherein the cylindrical structure in the step (b) is obtained by adhering glass powder containing at least one of copper oxide powder and copper powder to a glass sleeve made of Vycor glass.

11. The method for producing a high-pressure discharge lamp according to claim 9, wherein in the step (b), the electrode rod, which is connected to a metal foil at a second end of the rod, is passed through the cylindrical structure such that at least a part of the metal foil is covered with the cylindrical structure.

12. The method for producing a high-pressure discharge lamp according to claim 11, wherein in the step (c), the electrode rod is inserted into the side tube portion such that the cylindrical structure is arranged on the metal foil side from a center between an end of the arc tube portion that is a border with the side tube portion and an end of the metal foil that is connected to the electrode rod.

* * * * *

UNITED STATES PATENT AND TRADEMARK OFFICE

CERTIFICATE OF CORRECTION

PATENT NO. : 6,573,656 B2
DATED : June 3, 2003
INVENTOR(S) : Yuriko Kaneko et al.

It is certified that error appears in the above-identified patent and that said Letters Patent is hereby corrected as shown below:

Column 12,
Line 33, “rode” should be -- rod --.

Signed and Sealed this

Fifteenth Day of June, 2004

JON W. DUDAS
*Acting Director of the United States Patent and Trademark Office*